US007453357B2

(12) United States Patent
Bernal-Silva et al.

(10) Patent No.: US 7,453,357 B2
(45) Date of Patent: Nov. 18, 2008

(54) ARTICLE LOCATING SYSTEM

(75) Inventors: Richard Anthony Bernal-Silva, Springfield, NJ (US); Janice Ann Lopez, Springfield, NJ (US); Miroslaw Bogdanowicz, Manville, NJ (US)

(73) Assignee: Pereva, Inc., Springfield, NJ (US)

( * ) Notice: Subject to any disclaimer, the term of this patent is extended or adjusted under 35 U.S.C. 154(b) by 125 days.

(21) Appl. No.: 11/243,594

(22) Filed: Oct. 5, 2005

(65) Prior Publication Data

US 2006/0077056 A1 Apr. 13, 2006

Related U.S. Application Data

(60) Provisional application No. 60/616,280, filed on Oct. 6, 2004.

(51) Int. Cl.
*G08B 1/08* (2006.01)

(52) U.S. Cl. ..... 340/539.32; 340/568.7; 340/571; 340/572.1; 340/691.3; 340/692; 340/815.45; 340/815.65

(58) Field of Classification Search ..... 340/539.32, 340/568.7, 571, 572.1, 505, 692, 691.3, 691.4, 340/328, 332, 815.45, 815.65, 691
See application file for complete search history.

(56) References Cited

U.S. PATENT DOCUMENTS 5,298,883 A * 3/1994 Pilney et al. ..... 340/573.2
5,794,768 A 8/1998 Skeffington et al.
5,939,981 A * 8/1999 Renney ..... 340/539.32
6,265,973 B1 7/2001 Brammall et al.
6,297,737 B1 * 10/2001 Irvin ..... 340/571
6,317,025 B1 11/2001 Leon et al.
6,366,202 B1 4/2002 Rosenthal
6,501,378 B1 12/2002 Knaven
6,529,142 B2 3/2003 Yeh et al.
6,535,125 B2 3/2003 Trivett
6,573,833 B1 6/2003 Rosenthal
6,674,364 B1 1/2004 Holbrook et al.

(Continued)

OTHER PUBLICATIONS

FOFA®—Find One, Find All® Key Finder & Remote Control Locators Manual (dated May 2005) The date when the manual was first published is unknown.

(Continued)

*Primary Examiner*—Thomas J Mullen, Jr.
(74) *Attorney, Agent, or Firm*—Carella, Byrne, et al.; G. Glennon Troublefield

(57) ABSTRACT

An article locating system comprises a first unit having a housing and a circuit for generating a coded search signal that is unique to the first unit. The first unit operatively communicates with a second unit attached to the article to be located. The second unit includes a housing and a circuit for receiving the search signal and for generating a found signal. The second unit transmits the found signal to the first unit which then responds by selectively activating an indicator connected to the circuit of the first unit. The indicator preferably includes an array of indicator lights that are programmed to illuminate in a sequence to indicate the proximate position of the second unit relative to the first unit for locating the article. In an alternative embodiment, the second unit includes a record/playback device for recording and playing an audible communication in response to receiving the first signal from the first unit.

29 Claims, 7 Drawing Sheets

U.S. PATENT DOCUMENTS

| | | | | |
|---|---|---|---|---|
| 6,694,258 | B2 | 2/2004 | Johnson et al. | |
| 6,774,787 | B1 * | 8/2004 | Melbourne | 340/539.32 |
| 6,788,199 | B2 * | 9/2004 | Crabtree et al. | 340/539.32 |
| 6,943,679 | B2 * | 9/2005 | Sebanc et al. | 340/505 |
| 2003/0011478 | A1 * | 1/2003 | Rabanne et al. | 340/573.4 |
| 2004/0017293 | A1 * | 1/2004 | Webster | 340/539.32 |
| 2004/0130451 | A1 | 7/2004 | Cowell | |
| 2004/0217859 | A1 * | 11/2004 | Pucci et al. | 340/539.32 |

OTHER PUBLICATIONS

Printout of pages of web site www.findonefindall.com on Dec. 15, 2005 for Find Lost keys, Misplaced Remote Controls and Wallets—Fast with our FOFA 2 Way Finders, registered Trademarks of Melboume Design, LLC, Arlington, Texas, USA 7600. The date that the content of the pages of the web site were published is unknown.

ISD1600 Series, Single-Message Single-Chip 6.6- to 40-Second Duration Voice Record/Playback Device Manual, Publication Release Date : Nov. 4, 2004.

Integration, IA4420 Universal ISM Band FSK Transceiver Wireless Data Sheet, Rev 1.3, dated Jun. 2005, www.integration.com.

* cited by examiner

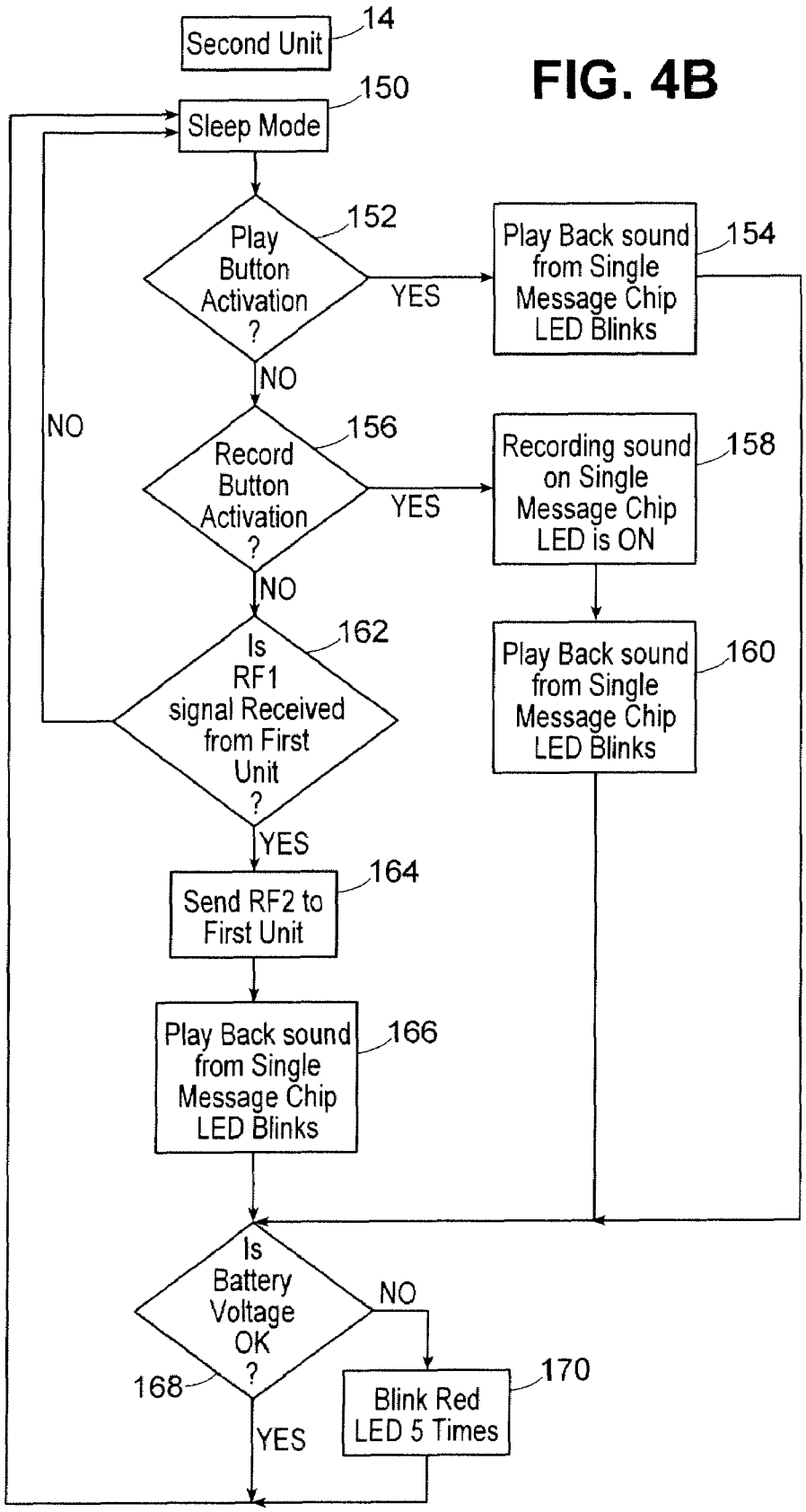
Second Unit
14
FIG. 4B
Sleep Mode
150
Play Button Activation ?
152
YES
Play Back sound from Single Message Chip LED Blinks
154
NO
NO
Record Button Activation ?
156
YES
Recording sound on Single Message Chip LED is ON
158
NO
Is RF1 signal Received from First Unit ?
162
Play Back sound from Single Message Chip LED Blinks
160
YES
Send RF2 to First Unit
164
Play Back sound from Single Message Chip LED Blinks
166
Is Battery Voltage OK ?
168
NO
Blink Red LED 5 Times
170
YES

ARTICLE LOCATING SYSTEM

REFERENCE TO PRIOR APPLICATION

This application claims the benefit of U.S. Provisional Application 60/616,280, filed on Oct. 6, 2004, entitled "System and Method for Locating Personal Items" in the name of Richard Anthony Bernal-Silva and Janice Ann Lopez.

FIELD OF THE INVENTION

The present invention relates to devices for locating articles, such as personal items. In particular, the invention relates to a system and method for locating an article that is positioned away from a user.

BACKGROUND OF THE INVENTION

The use of devices and systems for locating lost personal items is known in the art. It is not uncommon for an individual to misplace car keys, house keys, keys to a lock, and the like. Often, an individual who is in possession of the keys will place the keys in a particular location. When it comes time for the individual to use the keys, he cannot remember, or has difficulty recalling, the location where the keys were last placed. As a result, the individual will search for the whereabouts of his keys in vain, hoping that he can recall where the keys were placed. If the person is unable to locate the keys, the keys will have to be replaced, which can be at great cost and expense.

Prior art locator devices have been used in the location of parked automobiles and personal articles. For example, U.S. Pat. No. 6,694,258 to Susan Johnson and Tejas Desal, which is incorporated herein by reference, shows a car locator system that comprises a hand-held locator that receives information with regard to the location of the vehicle. The device shown in Johnson is adapted to register the location of a car that is positioned in a parking space, such that the operator will be able to more easily find the vehicle when parked. The device shown in Johnson does not solve the problem of lost personal items, such as a set of keys.

Despite the device shown in the patent issued to Johnson and Desal, the problem of locating personal items still exits. Over the course of a particular year, people waste valuable time searching for articles that have been misplaced, which creates a problem. Searching for misplaced items can cause a person to be late for appointments, miss airplane departures, delay the opening of a business and, overall, unnecessarily delay or even prevent the person from undertaking their respective daily routine. When a person is late for an appointment, business can suffer economically by resulting in lost sales and lost customers. In addition, in cases of an emergency, precious time can be wasted looking for misplaced personal items.

A number of prior art devices have attempted to solve the problem of finding misplaced articles and other personal belongings. For example, U.S. Pat. No. 6,535,125 to Sam W. Trivett, which is incorporated herein by reference, shows a remote control locator system that is adapted to be retrofitted onto a remote control device. The locator system comprises a sending unit and a receiving unit that is attachable to a conventional remote control unit. The sending unit is designed to activate the receiving unit by emitting a preprogrammed or randomly chosen locator signal that is transmitted to the receiving unit. The locator system is adapted for use with a remote control, as opposed to discrete, relatively small personal items such as a set of keys.

U.S. Pat. No. 6,529,142 to Shipong Norman Yeh, which is incorporated herein by reference, shows a system for locating a vehicle that is parked in a parking lot. The system comprises two separate signal generator/processor circuits that are contained in separate modules. One module is hand held and is activated by a user. When the user activates the hand held module, a signal is generated that is transmitted for use in the determination of the position of the vehicle. In response, the second module emits a direction indicating signal to the first module, which then displays the direction and elevation of the vehicle relative to the user. The device shown in Yeh, however, is not adapted to be used with smaller personal items, such as a set of keys.

U.S. Pat. No. 6,501,378 to Peter J. Knaven, which is incorporated herein by reference, shows an item locator system. The locator system includes a first device for receiving and transmitting a signal over free space. The first device includes a receiver that is adapted for sending a plurality of signals, each having a distinct frequency. The signals are received by a first transceiver. A speaker is provided for emitting an audible sound when the lost item is located. However, the device must be programmed by the operator in order to be used in determining the location of the lost personal item. The system taught by Knaven is limited for use in searching for a parked automobile as opposed to discrete articles, such as personal items.

None of the devices described in the foregoing patents, taken either singularly or in combination, solve the problem addressed by the instant invention. Specifically, the devices of the foregoing patents still do not recognize or solve the problem of locating relatively small personal items, articles and objects, such as a set of keys, wallets, watches, pocketbooks, and the like, that are lost, misplaced, stolen or are positioned away from the user.

In order to address the problems set forth immediately above, it is desired to provide an article locating system. Also, it is desired to provide a system and method for locating an article that is positioned away from the user that communicates to the user how close or far away the user is to the article that he is attempting to locate. It is also desired to provide a hand-held, relatively small device for use in determining the position of a personal item or article that has been lost, stolen, or misplaced. Still yet, it is desired to provide a system for locating a personal item, using audio/visual means to indicate to the user the approximate position of the article. It is further desired to provide an article locating system that is inexpensive and easy to use.

Further objects and advantages of the present invention will be apparent from the description of the invention and appended claims.

SUMMARY OF THE INVENTION

An article locating system is provided, comprising a first unit and a second unit for locating an article. The first unit includes a first circuit for transmitting a first signal and for receiving a second signal, and an indicator device connected to the first circuit. The first unit is operatively connected to a power supply having a given magnitude. The second unit includes a second circuit for receiving the first signal and for transmitting the second signal. The second unit is releasably attached to the article. In operation, the first circuit responds to the received second signal and selectably activates the indicator device to manifest the magnitude of power in the power supply and the proximate position of the second unit relative to the first unit for locating the article.

BRIEF DESCRIPTION OF THE DRAWINGS

For the purpose of illustrating the invention, there is shown in the drawings a form that is presently preferred; it being understood, however, that this invention is not limited to the precise arrangements and instrumentalities shown.

FIGS. 4A and 4B are flow charts showing the operation of an exemplary computer program of the first unit and an exemplary computer program of the second unit for operating the system, as shown in FIG. 1.

DETAILED DESCRIPTION OF THE PREFERRED EMBODIMENTS OF THE INVENTION

Figure 1:
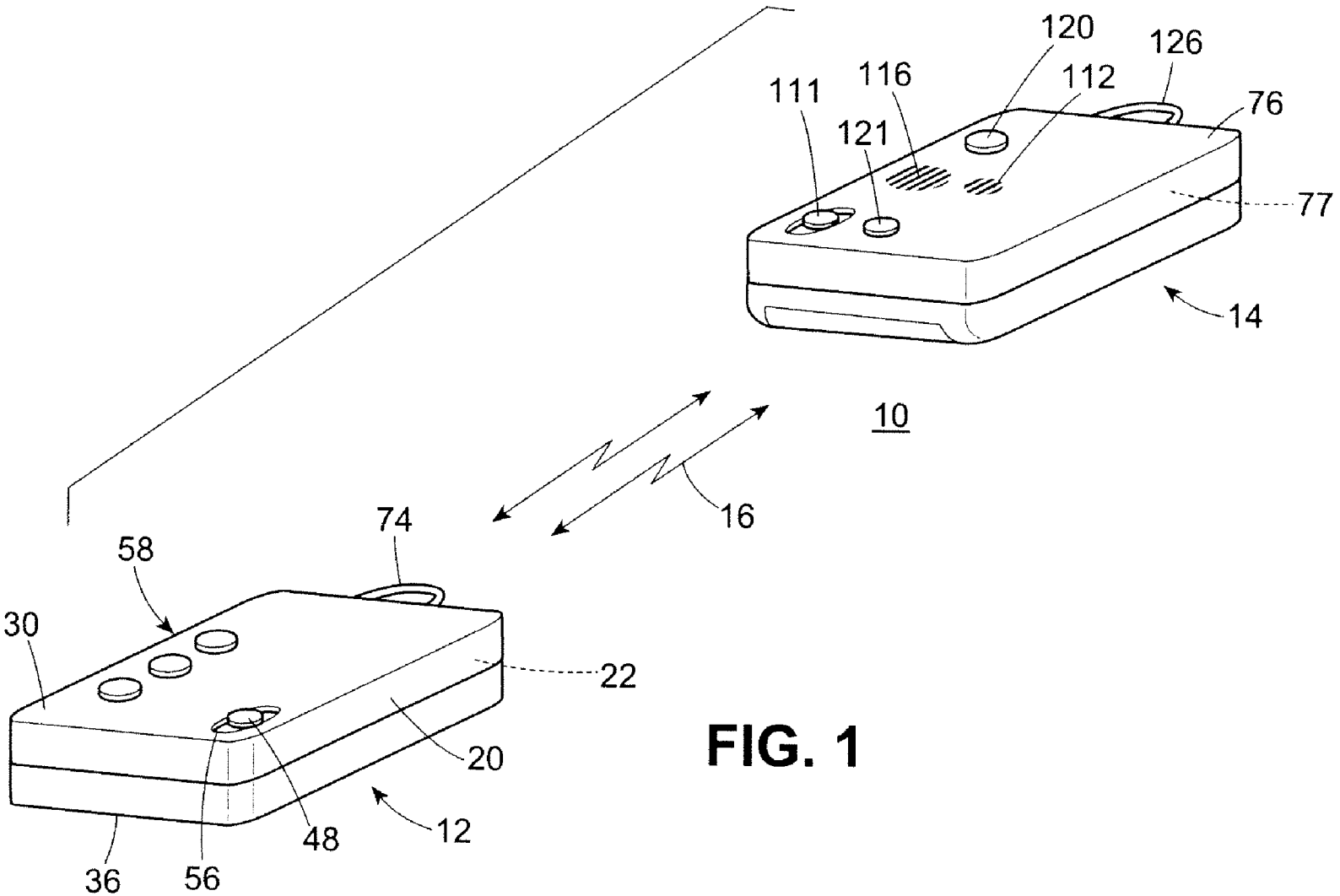
FIG. 1 is a perspective view of an article locator system of an embodiment of the present invention, comprising a first unit with a first indicator and a second unit with a second indicator.

Turning now to the drawings, where like numerals represent like elements, there is shown an embodiment of the present invention that is presently preferred. As shown in the drawings, the present invention is directed to a system and method for locating an article, such as a discrete personal item, that is lost, stolen, misplaced or mislaid by the user. The system of the present invention is designed for use with articles, such as a set of keys, a wallet, or other type of relatively small personal belonging that individuals typically own.

FIG. 1 shows an exemplary embodiment of an article locating system 10 contemplated by the present invention. The system 10 comprises a remote two-way, preferably hand-held first unit 12, also referred to as a locator or transmitter module. The first unit 12 is in selective communication with a second unit 14, also referred to as a receiver or base module. The first unit 12 and the second unit 14 are electronically designed to communicate with one another over free space through a wireless communications link 16. The second unit 14 is adapted to be fixed or attached to an article so that its response to the first unit 12 is used to search for and determine the proximate position of the article.

The first unit 12 and second unit 14 are electrically designed so that they transmit and receive electronic signals when activated. The signals are typical radio frequencies (RF), which are the portion of the electromagnetic spectrum with frequencies between 3 kilohertz and 300 gigahertz. It is contemplated that any known electronic transmission and receiver circuits in which two electronically controlled devices communicate with one another can be used in keeping with the present invention. Those of ordinary skill in the electronics art understand the type of means in which the first unit 12 and the second unit 14 selectively communicate with one another. Therefore, further description of the transmission and receiver circuits is not necessary.

Figure 2:
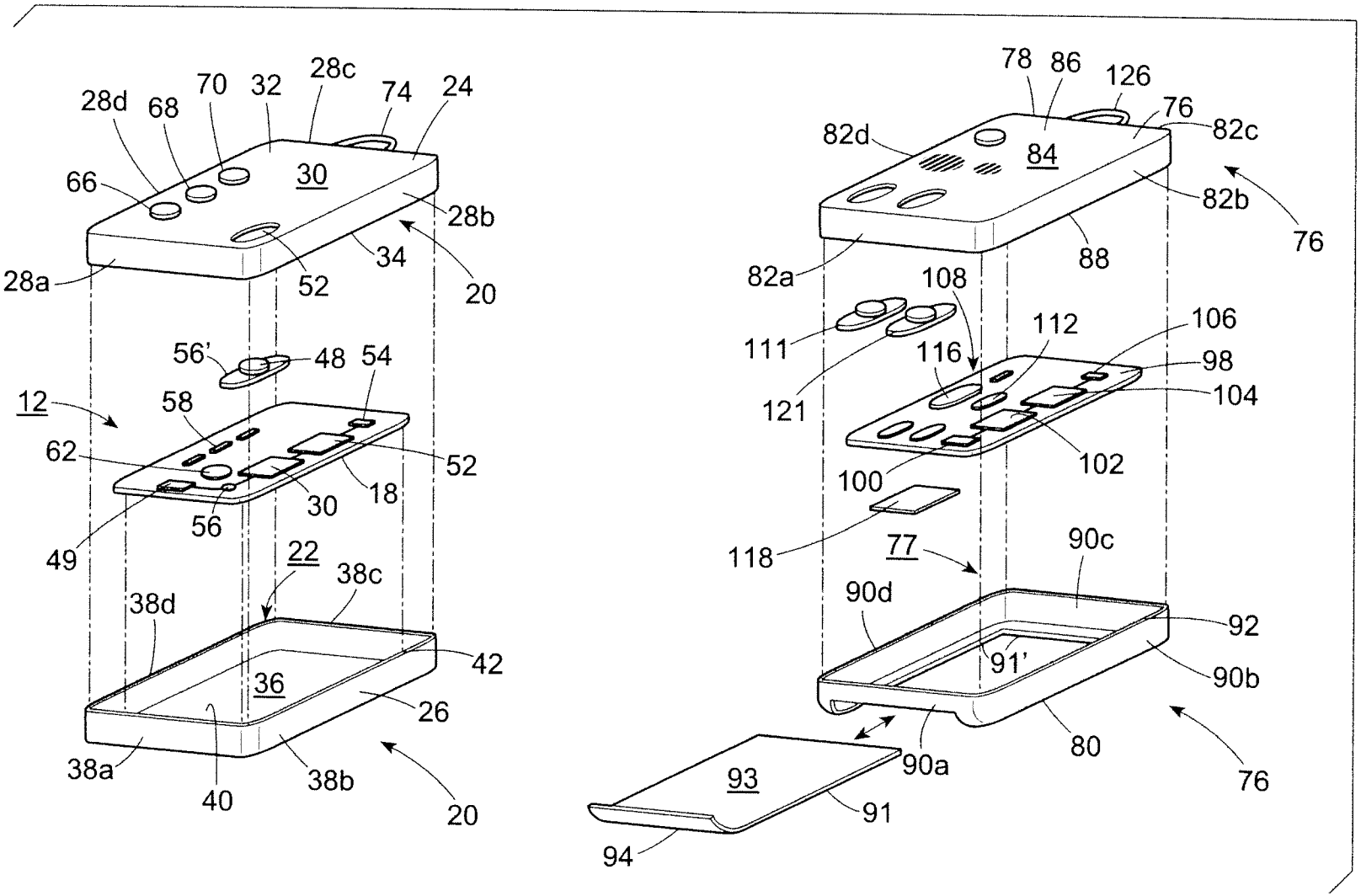
FIG. 2 is an exploded view of the first unit and the second unit, as shown in FIG. 1.

As shown in FIGS. 1 and 2, the first unit 12 includes a circuit 18, a housing 20, and an interior 22. The interior 22, which is shown in FIG. 1 by the broken lead line to reference numeral 22, is within the housing 20. The housing 20 is a relatively thin wall protective shell for the circuit 18 and, in the exemplary embodiment best seen in FIG. 2, is formed by a first member 24 that is releasably joined to a second member 26. The first member 24 includes a plurality of sides 28*a*, 28*b*, 28*c*, and 28*d* that are joined at their edges to a first protective member 30 having an inner surface (not shown) and an outer surface 32. Sides 28*a*, 28*b*, 28*c*, and 28*d* are integrally formed with and extend away from the first protective member 30, terminating at a peripheral edge 34.

The second member 26 includes a plurality of sides 38*a*, 38*b*, 38*c*, and 38*d* that are joined at their edges to a second protective member 36 having an inner surface 40 and an outer surface (not shown). Sides 38*a*, 38*b*, 38*c*, and 38*d* are preferably integrally formed with and extend away from the second protective member 40, terminating at a second peripheral edge 42. Edge 42 defines the thickness of the second member 26 and a second portion of the interior 22. The first member 24 and the second member 26 form interior 22 when joined at their respective edges, 34 and 42.

The first member 24 is preferably joined to the second member 26 using adhesives, screws, and other locking mechanisms that are well known in the art. For example, edge 34 can be shaped and dimensioned relative to edge 42 to form a press-fit, locking mechanism to releasably secure the first member 30 to the second member 40. In that regard, the first member 24 and the second member 26 snap-fit together to form a substantially unitary housing 20.

The first unit 12 housing 20 is molded from relatively hard, thermoplastic material and is about approximately 2 inches in length, 1 and ½ inches in width, and a ½ inch in height. The housing 20 is small enough to fit comfortably in the palm of the user's hand. It should be understood, of course, that the housing 20 can be any shape or size that is desired and is not limited to the embodiment shown in FIGS. 1 and 2. The housing 20 is large enough to accommodate electric components that will fit within the interior 22.

Figure 3:
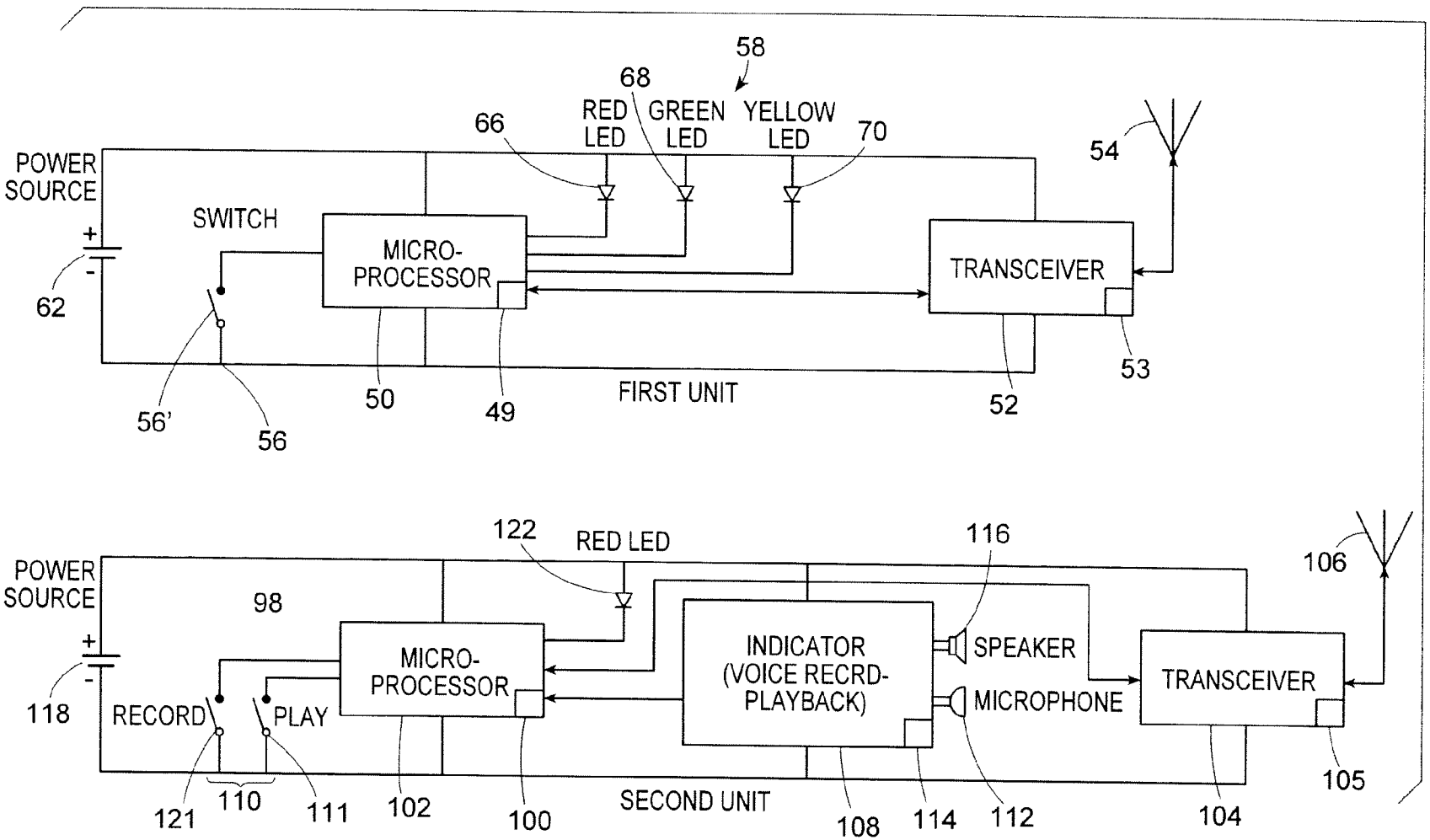
FIG. 3 is a simplified block diagram illustrating a circuit of the first unit and a circuit of the second unit.

The circuit 18 is shaped and dimensioned to fit within the interior 22 of the housing 20. The circuit 18 includes an integrated circuit on a circuit board or chip for operating the first unit 12. As best seen in FIGS. 2 and 3, the circuit 18 includes memory 49, a microprocessor 50, a transceiver 52, an antenna 54, an activation mechanism 56 and an indicator 58. Memory 49 is associated with the microprocessor 50 and is volatile or non-volatile, such as RAM and ROM, for storing retrievable data used to operate the system 10. For example, memory 49 is advantageously used to store pre-desired identification data that is unique to the first unit 12 or the system 10. The identification data includes any combination of alphanumeric identification encoded data that will distinguish the first unit 12 or system 10 from other similar devices. The identification data comprises information such as the serial number of the particular first unit 12 and second unit 14, the SKU used by a manufacturer, the name and address of the user, or other identifying data. Once stored within memory 49, the microprocessor 50 embeds the signal that is transmitted by the first unit 12 to the second unit 14 with at least a portion of the identification data so that the signal is distinguishable from other signals in free space. In addition, the microprocessor 50 uses the identification data to verify an inbound signal that may be received from the second unit 14 as being valid. In that regard, the microprocessor is preprogrammed by a computer program stored in memory 49, such that only authorized signals that uniquely identify the first unit 12 and second unit 14 are sent and received by the first unit 12.

The microprocessor 50 may be a single integrated circuit chip, low power pre-programmed microcontroller that is used to fetch, decode, and execute instructions from memory 49 and to transfer information to and from other components of the circuit 18 to operate the first unit 12. Microprocessors are well known in the art and can be purchased from a number of manufacturers, such as AMTEL and MICROCHIP. The microprocessor 50 of the present invention is pre-programmed with a number of subprograms and routines to operate the first unit 12 and is electronically connected to other the components of the circuit 18, such as the transceiver 52. The method of making a pre-programmed integrated circuit chip of the type described herein is known in the art, therefore, further discussion is not necessary.

The transceiver 52 is connected to the microprocessor 50 and is provided to send or transmit a first search signal to the second unit 14 through antenna 54. The transceiver 52 also listens for, receives and detects second found signals that may be transmitted from the second unit 14 when the system 10 is being operated. The transceiver 52 is preferably a single integrated circuit chip, low power, multi-channel FSK transceiver designed for use in applications requiring conformance with unlicensed frequency bands to range from approximately about 900 MHz to approximately about 1100 MHz. The transceiver 52 is integrated for easy RF design, low battery use, and preferably includes memory 53, an integrated digital data processing feature for data filtering, data pattern recognition, and a wake-up timer to extend the life of the battery. The transceiver 52 transmits the first signal of about approximately 900 MHz having sufficient power to about approximately 930 MHz to cover a distance therefrom that is desired, such as about 20 feet or about 50 feet. It should be understood that the present invention is not limited to any particular distance range.

In a preferred embodiment, the transceiver 52 is programmed to operate in conjunction with the microprocessor 50 in a sleep/wake-up mode. In the sleep/wake-up mode, the transceiver 52 is activated by programmable wake-up events stored within the microprocessor 50, such that when the activation mechanism 56, e.g., a push button switch, is operated or the first unit 12 receives a found signal from the second unit 14. The transceiver 52 and microprocessor 50 are programmed with wake-up logic that will communicate with one another such that the microprocessor 50 generates and transmits to the transceiver 52 an interrupt signal, which is used to wake up the transceiver 52. When the interrupt signal is received, the transceiver 52 will transmit into free space an encoded first signal that is generated to search for the second unit 14. Preferably, the transceiver 52, independently or in combination with the microprocessor 50, will encode the first signal with a portion of the identification data so that the first signal will be unique to the first unit 12 and to the second unit 14. The first signal is transmitted through the antenna 54 into free-space to search for and locate the second unit 14. Transceivers are available from a number of manufacturers, as the IA4420 Universal ISM Band FSK transceiver available from Integration Associates, Inc. of Mountain View, Calif.

The activation mechanism 56 is operatively connected to the circuit 18 for actuating the microprocessor 50 to commence the search process of the system 10. As shown in FIGS. 1 and 2, the activation mechanism 56 is preferably a push-button switch that is operated by a user to activate the first unit 12 to initiate a search sequence for the position of the second unit 14 and, by association, the article. It is contemplated that an actuator, switch or audible recognition device to initialize the program stored within the microprocessor 50 can be used as the activation mechanism 56. For example, the electronic transmission of the first signal of the first unit 12 can be initiated by an audible sound such as the clap of a hand or the user's voice, when voice or sound activated components are incorporated.

In the exemplary embodiment shown in FIGS. 1, 2 and 3, the activation mechanism 56, preferably a switch 56', is by operated by sliding or pushing the button 48 that projects through a through hole 52 formed within the first protective member 30 of the first unit 12. Operating the button 49 turns the first unit 12 "on" causing electric current to flow to the circuit 18 from a power source 62. The power source 62 can be a cell, battery, or other means to supply a source of electric current for operating components of the first unit 12, as shown in FIG. 3. The flow of power initializes microprocessor 50 so that the first unit 12 will initialize the programs stored within memory 49 to begin the process of generating and transmitting the first search signal to locate for the second unit 14.

As shown in FIG. 2, indicator 58 is provided to indicate or announce to the user the proximity of the first unit 12 relative to the second unit 14. The indicator 58 is any audio device, a visual device, or any combination thereof, that includes a portion that is visible to or can be heard by the user, and may include a light and/or a speaker. The indicator 58, represented in FIG. 3 by LEDs, 66, 68 and 70, is electrically connected to the power source 62 and microprocessor 50. Once activated, the indicator 58 notifies the user that the second unit 14, and by association the article, is within or is out of range. In addition, the indicator 58 is preferably used to indicate the strength of the power source 62 to alert the user that the power source should be re-energized or replaced, as necessary.

As shown in FIGS. 2 and 3, the indicator 58 may be a visual display device that includes an array of light emitting diodes (LEDs) (three shown) LEDs 66, 68 and 70. The LEDs are aligned side by side relative to one another, each being electrically connected to the microprocessor 50, which is programmed to illuminate one or more of the LEDs in a given sequence that is desired. As one example, the microprocessor is programmed to illuminate each LED 66, 68 and 70 one after the other to indicate to the user that the proximity of the second unit 14 relative to the first unit 12 is getting closer, further apart, or is out of range. For example, the frequency of illumination increases to show the second unit getting closer or decreases to show the second unit getting further away from the first unit 12. As another example, the intensity in which each or one of the LEDs 66, 68 and 70 is illuminated can be used to indicate to the user the relative distance that the user is from the second unit 14 and, therefore, the article. The intensity of the illumination increases or decreases as the first unit 12 gets closer or further away from the second unit 14.

As another example, the microprocessor 50 can be programmed to illuminate one or more of the LEDs in stages from relatively dim to bright as the user moves within close proximity to the position of second unit 14 and, by operation, the position of the article. The staging of illumination of the LEDS is programmed such that the relative strength of the found signal, based upon values stored in memory, is processed and converted to control the magnitude of the power that is permitted to flow to each LED, via a resistor network and transistor switches. It is also contemplated that other visual display means similar to LEDs, such as a liquid crystal display, can be used wherein variable length of bars indicate the proximity of the first unit 12 to the second unit 14.

In the preferred embodiment, LED 66 illuminates red, LED 68 illuminates yellow and LED 70 illuminates green. The microprocessor 50 is programmed to control the activation of each LED. The red LED 66 illuminates when the second unit 14 is out of range and the first unit 12 receives no second signal. In addition, as a separate feature, the red LED 66 will blink a number of times to indicate that the power source 62 is low.

Microprocessor 50 is also programmed such that when the transceiver 52 is energized, the transceiver 52 will listen for inbound second signals having two components, namely a strong component and a weak component. If a strong component of the second signal is detected the strong signal is transmitted to the microprocessor 50 that validates and measures the magnitude or strength of the signal. If a strong signal is received, microprocessor 50 illuminates yellow LED 68. Illumination of the yellow LED 68 occurs when the second unit 14 is approximately within the range of about 10 feet to approximately 20 feet of the first unit 12. The range is determined by the detection of the strength of the second signal from the second unit 14, using standards that are pre-programmed into the memory 48 used by the microprocessor 50. If a weak component of the second signal is also detected, then the microprocessor 50 will illuminate the green LED 70, indicating to the user that the article is within close proximity to the first unit 12, such as between the range of approximately 0 and 10 feet. The words "weak" and "strong" are relative terms and are used to define the results of a program within the microprocessor 50 for measuring the magnitude or strength of the frequency components of the second signal in comparison with preselected standards that are stored within memory 48. The programming of the microprocessor 50 and transceiver 52 to determine the proximate position of the second unit 14 relative to the first unit 12 is within the skill of those of ordinary skill in the art. It should be understood, of course, that the present invention is not limited to any number of feet or range that the first unit 12 can be used to locate the second unit 14. Likewise, those of ordinary skill will appreciate that the LEDs may be any color, have any intensity, and may change color as a means to indicate to the user the distance in which the user must traverse to be within close proximity to the article.

Figure 1B:
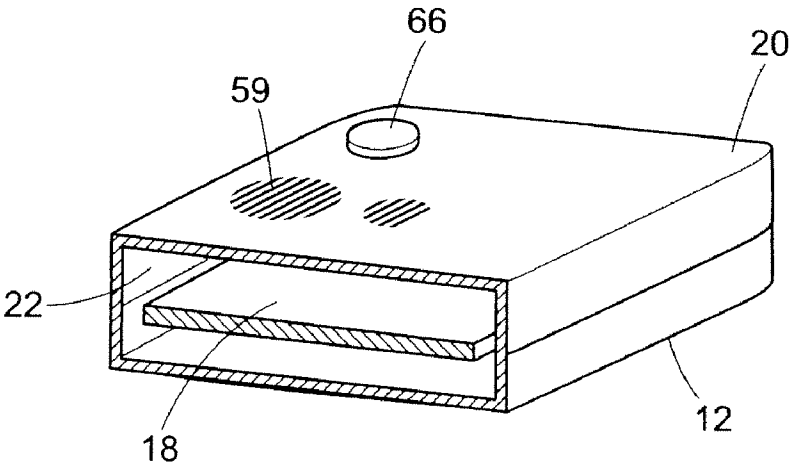
FIG. 1B is a perspective view of a fragment of the first unit shown in FIG. 1, illustrating an alternative exemplary embodiment of the first indicator.
Figure 1A:
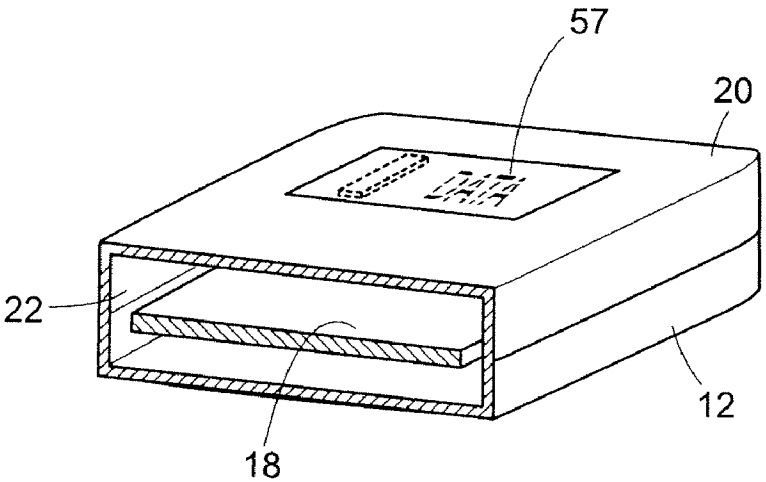
FIG. 1A is a perspective view of a fragment of the first unit shown in FIG. 1, illustrating an alternative exemplary embodiment of the first indicator.

As shown in the alternative embodiment of FIG. 1A, the indicator 58 can be replaced with a screen, such as a liquid crystal display (LCD) 57. The LCD 57 is used to display information as to the position of the article relative to the user. The LCD 57 has a graphic interface that can be used to simulate a graduated set of bars or lights, similar to the magnitude of a received signal of a cellular phone, as indicating the strength of the signal. In that regard, the program run by the microprocessor 50 controls the size and/or intensity of the bars to increase when the second unit 14, and therefore the article, is within close proximity to the position of user or the first unit 12. It is also contemplated that the graphic interface of the LCD can displays alphanumeric data, such as the bar and the word "Data" shown in FIG. 1A in phantom, as to the location or direction in which the article is located, relative to the user. Other visual display and announcing mechanisms for communicating to the user the position of the second unit 14 or the position of the article externally, are contemplated.

In the alternative embodiment shown in FIG. 1B, the indicator is an audio device 59, such as a beeper, speaker or similar device or mechanism for emitting an audible response or sound. The audio device 59, when within proximity of the second unit 14, emits an audible sound that is activated when the second unit 14 receives the first signal from the first unit 12. The audio device 59 can also emit an audible sound when the first unit 12 receives the found signal transmitted from the second unit 14. The loudness, e.g., the decibels of the audible sound that is emitted from the speaker, is set to have a value to indicate the distance of the user relative to the position of the personal item. For instance, the closer the distance, the louder the sound. The audio device 59 can be programmed to emit a chord, a chime, a beep, a ring, and other audible sounds that will assist or will be construed as indicting the position of the article. When an audio device 59 is used, at least one LED 66 is also used for purpose of manifesting the strength of the power source.

The first unit 12, as shown in FIG. 1, preferably has an attachment portion 74 that is used to releasably attach the first unit 12 to another object or device, e.g., a key ring, a belt, a purse and so on. As shown in FIG. 2, the attachment portion 74 is a ring that is integrally formed to and secured to side 28*c* of the housing 20. The attachment portion 74 can be any device, mechanism, or means in which to removably secure the first unit 12 to another object. Those of ordinary skill in the securing art will understand that there are a variety of means in which one object can be removably secured to another object, such that further description is unnecessary.

As shown in FIGS. 1 and 2, the second unit 14 includes a housing 76 and an interior 77. The interior 77, which is shown in FIG. 1 by the broken lead to reference numeral 77, is within the housing 76. The housing 76 is a relatively thin wall protective shell for a circuit 98 and, in the exemplary embodiment best seen in FIG. 2, comprises a first member 78 releasably joined to a second member 80. The first member 78 includes a plurality of sides 82*a*, 82*b*, 82*c*, and 82*d* (four shown) that are joined at their edges to a first protective member 84 having an outer surface 86 and an inner surface (not shown). The sides 82*a*, 82*b*, 82*c*, and 82 extend away from the first protective member 84, terminating at an edge 88. The edge 88 is preferably used to releasably join the first member 78 to the second member 80.

The second member 80 comprises a plurality of sides 90*a*, 90*b*, 90*c*, and 90*d* that are joined at their edges to a second protective member 91 having an inner surface 93 and an outer surface (not shown). Sides 90*a*, 90*b*, 90*c*, and 90*d* are preferably integrally formed with and extend away from a portion of the second protective member portion 91', terminating at edge 92.

A sliding door 94 is provided to permit access to the interior 77 of the second unit 14. The door 94 forms a portion of the second protective member 91 and is shaped and dimensioned to slide and lockingly mate with portions of the protective member 91'. The sliding door 94 acts as a cover to provide access to the circuit 98.

The housing 76 of the second unit 14 is preferably molded from relatively hard, thermoplastic material and is about approximately 2 and ½ inches in length, 2 inches in width, and 1 and ½ inches in height. The housing 76 is shaped and dimensioned so that it is small enough to attach to the article without making the article awkward to use. Preferably, the housing 76 is attached to the article using an attachment device 126, such as key loop or eye, as one example. It should be understood, of course, that the housing 76 can be any shape or size that is desired and is not limited to the embodiment shown in FIG. 1.

The circuit 98 located within the housing 76 is shaped and dimensioned to nest within the interior 77. As best seen in FIG. 3, the circuit 98 includes an integrated circuit on a circuit board that includes memory 100, microprocessor 102, a transceiver 104, and antenna 106, a record-playback mechanism 108 and an externally observable or sensed indicator 120, which may be an LED 122. The memory 100 is associated with the microprocessor 102 and is used as both volatile and non-volatile memory, such as RAM or ROM type memory, for the purpose of storing data used to operate the system. Memory 100 is similar to memory 49 of the first unit 12. Therefore, further discussion is unnecessary, it being understood, of course, that memory 100 is used to store identification data that is unique to the first unit 12, the second unit 14 or the system 10. The identification data includes any combination of alphanumeric data that is stored in computer language that will distinguish the second unit 14 from other similar devices.

The microprocessor 102 is any typical single integrated circuit chip, low power pre-programmed microcontroller that is used to fetch, decode, and execute instructions and to transfer information to and from other components of the circuit 98 to operate the second unit 14. Microprocessors for use in the second unit 14 are well known in the art and can be purchased from a number of manufactures, such as AMTEL and MICROCHIP. Microprocessor 102 is similar to microprocessor 50, such that further discussion is not necessary.

The transceiver 104 is connected to the microprocessor 102 and listens to receive the first signal from the first unit 12. When a signal is received, the transceiver 104 transmits the signal to the microprocessor 102 for validation based upon predetermined validation parameters stored in memory 100. The parameters includes a range of frequencies that are encoded with a portion of the identification data. If the signal is valid, the microprocessor 102 initiates a program to instruct the transceiver 104 to transmit the second found signal to the first unit 12 through antenna 106. The transceiver 104 is similar to transceiver 52. Transceiver 104 is a preferably a single integrated circuit chip, low power, multi-channel FSK transceiver designed for use in applications requiring conformance with unlicensed frequency bands to range from approximately about 900 MHz to approximately about 1000 MHz. The transceiver 104 is an integrated circuit for easy RF design, low battery use, and preferably includes an integrated digital data processing feature for data filtering, memory 105, data pattern recognition, and a wake-up timer to extend the life of the battery.

In a preferred embodiment, the transceiver 104 is programmed to operate in connection with the microprocessor 102 in a sleep/wake-up mode. In the sleep/wake-up mode, the transceiver 104 is activated by programmable wake-up events stored within memory 100 of the microprocessor 104, such as when the inbound first signal is received from the first unit 12. The transceiver 104 and microprocessor 102 are programmed with wake-up logic that communicates with one another such that the microprocessor 102 generates and transmits to the transceiver 104 an interrupt signal, which is used to wake up the transceiver 104 when the first signal is received. When the first signal is received and validated, the microprocessor 102 generate the second signal so that it will include a strong and weak component, together with a portion of the identification data. Once generated, the microprocessor 102 instructs the transceiver 104 to transmit the second found signal into free space. The second signal is encoded with at least a portion of the identifying data so that the second signal is unique to the second unit 14 so that the first unit 12 and the second unit 14 can "talk" or communicate with one another through communications link 16. The transmission of the second signal is used to determine the proximate position of the second unit 14, and by association, the proximate position of the article.

In the preferred embodiment, the second unit 14 includes an indicator device 108 that is used to indicate to the user the proximate position of the second unit 14. The indicator 108 is preferably a voice record/playback device that is connected to the circuit 98, as best seen in FIG. 3. The record/playback device is a single-message, single integrated circuit chip, record/playback mechanism with selectable durations from about approximately 40 seconds to 90 seconds. The indicator 108 includes an oscillator/actuator (via external control) 110, comprising switches 111, 121, microphone 112, memory 114, and an audio generator device 116, such as a speaker or buzzer. Recording is stored into memory 114 that is in analog or digital form. The indicator 108 is operated by actuator 110, which is preferably a push-button switch interface that is operated externally by moving a switch button to record a message. The message can be played back by operating a "play button" switch 111 that is connected to the indicator 108 through the microprocessor 102. The indicator 108 plays a recording when the play button switch has been pushed. Preferably, the indicator 108 includes a standby mode that will disengage the indicator 108 once an operation is completed to save power.

To record an audible communication, the user operates a record button 121. Activating the record button 121 causes the microprocessor 102 to activate the microphone 112 so that an audible communication can be recorded by being saved into memory 114 in analog or digital form. The audible communication can be of any length, such as a message to announce the user's name or a desired communication such as "Here I Am" or "Hello [name] and [message]." Although the length of the audible communication can vary, it is preferable that the communication be approximately 20 to 40 seconds.

The audio device 116 is a mechanism for emitting an audible response or sound that alerts the user through speaker 116. The speaker 116 emits an audible sound that was recorded into memory 114 when the second unit 14 detects the first signal from the first unit 12. The decibels of the audible sound that are emitted from the speaker 116 can be programmed to vary, to indicate the distance the user is to the position of the second unit 14. In a preferred embodiment, the speaker can emit a chord, a chime, a beep, a ring, and a recorded message or other audible sounds to assist in the location of the position of the second unit 14 and therefore, the position of the article, such as a personal item.

Power is supplied to the second unit 14 by a removable power source 118 that is connected to the circuit 98. The power source 118 is preferably a battery that supplies power to the electronic components attached to the circuit 98. The battery maintains current for the circuit 98 for a number of months, particularly because there is no switch that will control the flow of current to the circuit 98. In view of the fact that the second unit 14 will draw current on a daily basis, the battery that is selected should be large enough to supply enough current for a number or months or years. However, power can be conserved by selecting components, such as the microprocessor 102 and transceiver 104, that require low energy to operate.

An indictor light, which is preferably LED 122, is connected to the power source 118 and microprocessor 102. The indicator light 122 indicates to the user the strength of the power source 118. If the power source is within acceptable levels, the LED blinks a number of times, such as five times.

As best seen in FIG. 1, an attachment portion 126 is provided to releasably attach the second unit 14 to the article or personal item so that the position of the personal item can be determined. As shown, the attachment portion 126 is a ring that is secured to the housing 44 that can be interlocked with a hole of the key. The attachment portion 126 can be any type of device, mechanism or means for releasably securing the second transceiver unit 14 to the article. For example, the attaching means might be Velcro, adhesive, tape, press-fit lock, and the like.

Figure 4A:
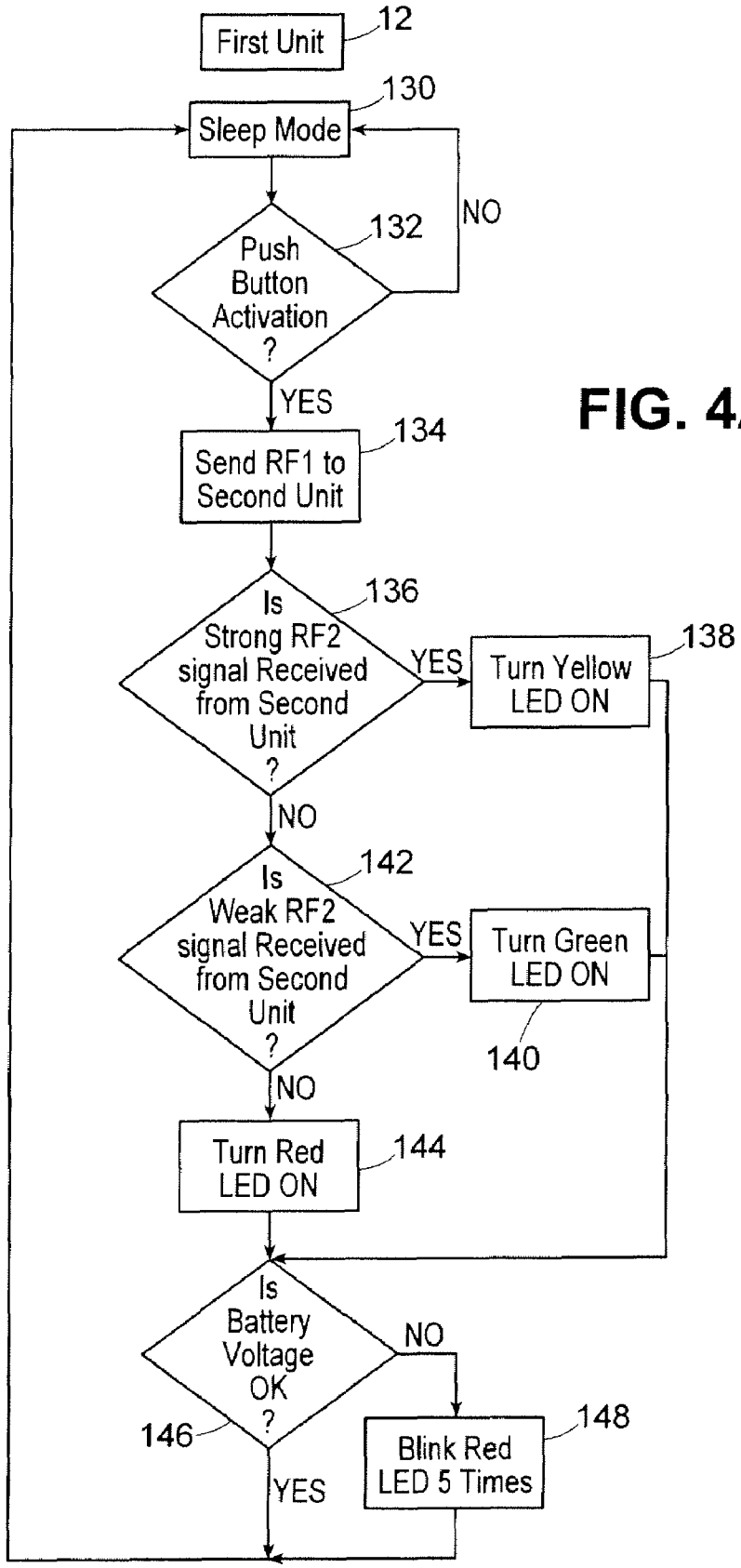

FIG. 4 are functional block diagrams illustrating the logic operation of the system 10 according to the present invention. As shown, the first unit 12 is in a sleep mode, at step 130. The activation mechanism, switch 56, is pushed by the user to actuate the microprocessor 50, at step 132. Operating the activation mechanism 56 wakes up the microprocessor 50 to access, as necessary, the memory 48 to fetch the programming to generate the first signal and to access the identification data that is preferably stored within memory 48. The microprocessor 50 encodes the first signal with a portion of the identification data and sends a data stream to the transceiver 52 in order to transmit the first signal into free space through antenna 54 to search for the second unit 14, at step 134. The first signal is referred to in step 134, as "RF1.

At the same time or immediately after the first signal is transmitted into free space to search for the second unit 14, the transceiver 52 activates the antenna 54 to listen for an inbound second signal, which is referred to as "RF2", at step 136. The second signal is generated by the second unit 14, and includes a strong component and a weak component that are advantageously used to determine the proximate position of the second unit 14 relative to the first unit 12. The strength of the strong component and the weak component are detected by the microprocessor 50, through transceiver 52, utilizing a program installed into memory 48 accessible by the microprocessor 50 that compares the magnitude or strength of the signal based upon preselected standards.

If the microprocessor 50 detects a strong second signal from the second unit 14, the microprocessor 50 generates an instruction to illuminate the LED at step 138, which is preferably yellow. If the microprocessor 50 detects the weak component of the second signal, at step 142, the microprocessor 50 performs instructions to illuminate the LED at step 140, which is preferably green. When the strong component and the weak component of the second signal are detected, then the green LEDs illuminates, which can be used to indicate that the user is within close proximity to the article. If neither a strong component nor a weak component is detected by the transceiver 52 and determined by the microprocessor 50, then the red LED is illuminated, at step 144.

After the microprocessor 50 determines the strength of the second signal, the microprocessor 50 determines if the power source 62, referred to as the battery voltage, falls within acceptable levels at step 146. If the power source 62 falls within acceptable levels, then the first unit 12 returns to sleep mode. If the power source does not fall within acceptable levels, then the microprocessor 50 causes the red LED to blink five times, at step 148. After the red LED blinks five times, the first unit 12 returns to sleep mode.

As shown in step 150, the second unit 14 returns to sleep mode to await a signal from the first unit 12. At step 152, the recorder is used to record a message that is replayed when the second unit 14 is activated. The user pushes the play button 111 to commence playing a message or other audible communication that was stored in memory 114. If the play button 111 is operated, the playback of the sound from the single message chip occurs, at step 154. The activation of the playback switch activates the microprocessor 102 to illuminate the LED 122, so that the LED will blink.

To record a message, the user pushes the record button switch 121 to record an audible communication, at step 156. As the recording of the audible communication occurs, the microprocessor 102 illuminates the LED 122, such that the LED is on, as indicated at step 158. When the user has finished recording the audible communication and the record button switch 121 is released, the audible communication can be replayed by operating the play button switch 111, at step 160. After the recorded audible communication has been played, the microprocessor 102 initiates a program to check the strength of the power source 118, which is referred to as the battery voltage at step 168. If the strength of the power source falls within acceptable levels, then the second unit 14 returns to sleep mode. If the strength of the power source is not within acceptable levels, then the microprocessor 100 will activate the LED 122, such that the LED blinks five times, at step 170. After the LED blinks five times, the second unit 14 returns to sleep mode.

The second unit 14 remains in sleep mode until the first signal, referred to as RF1, is received from the first unit 12, at step 162. Therefore, it should be understood that even though the second unit 14 is in the sleep mode, it is programmed to wake-up at varying times or periodically to listen for inbound first signals. In an alternative embodiment, the second unit 14 can remain partially awake such that the transceiver 104 will be supplied with enough power so that it can listen for inbound first signals. It is preferable that the transceiver 104 will listen for the first signal periodically in order to conserve power.

If the first signal (i.e., RF1) is received, then the microprocessor 102 generates the second signal that is encoded with at least a portion of the identification data that is stored into memory 100 so that the second signal (i.e., RF2) will be unique to the second unit 14. The signal will have two components, a strong portion and a weak portion, that are transmitted simultaneously by the transceiver 104 into free space so that the first signal can be detected by the first unit 12. It is contemplated, that the second signal is modulated to include a first frequency and a second frequency that will be received by the first unit 12, in which the first frequency can be interpreted as the "strong" signal and the second frequency can be interpreted as the "weak" signal.

After the second signal is transmitted to the first unit 12, the playback button switch 111 is activated by the microprocessor 102 to play the audible communication that was stored in memory 114, at step 166. As the audible communication is being played, the indicator 108 activated by illuminating the LED 122 so that the LED 122 blinks. After the LED 122 stops blinking, the strength of the power source is checked to determine whether the strength falls within acceptable desired levels, at step 168. After the power source is checked, the second unit 14 returns to sleep mode, at step 150.

Figure 5:
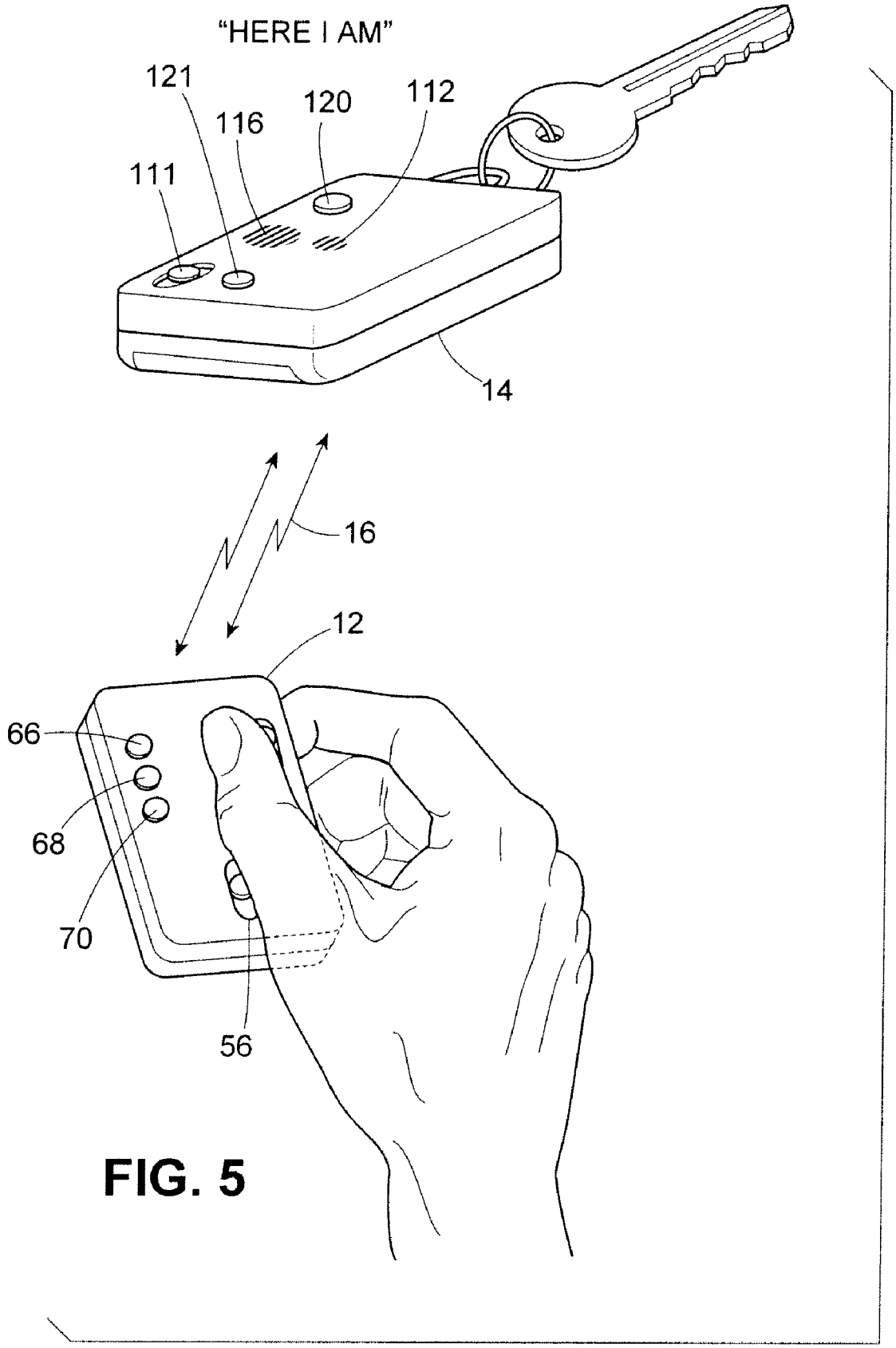
FIG. 5 illustrates use of an article locator system of the present invention for locating an article.

In the exemplary operation shown in FIG. 5, the first unit 12 is used in a first position to determine the whereabouts of a key, relative to a second unit 14 in a second position. As shown, the first unit 12 is held by a user in his or her hand. The first transceiver unit 12, as shown in the exemplary embodiment of FIG. 5, fits in the palm of a hand, with the fingers wrapping around the side of the housing so as to position the thumb over the activation mechanism 56, which is a switch. To activate the first transceiver unit 12 to search for the personal item, the thumb is moved downwardly toward the activation mechanism 56 (i.e., toward the bottom or into the paper) with sufficient force to operate the switch to supply power to the first unit. Those of ordinary skill will appreciate that the circuit of the first unit 12 can be normally opened or normally closed depending upon the state of the activation mechanism 56 (i.e., the switch) that is desired. For example, if the circuit is normally opened, then pressing the switch will close the circuit so that electric current can flow from the power source 62 to the microprocessor 50 (as shown in FIG. 4 and other components.

After the switch is closed by pressing the activation mechanism 56, current flows and initiates the microprocessor 50 to generate the first signal to search for the second unit 14. The second unit 14 will receive the first signal and then generate the second signal. The second signal is then transmitted to the first unit 12. In response to receiving the second signal, the indicator 58 illuminates based upon the strength of the second signal that is detected to indicate the proximity of the first unit 12 relative to the second unit 14. The user can move toward the second unit 14 for locating the personal item.

With respect to the above-description, it should be understood that the dimensional relationships of the parts of the first transceiver unit 12 and the second transceiver unit 14 can vary by size, type of materials selected, shape, form function, manner of operation, assembly, and use. Therefore, the foregoing description of the embodiment of the present invention is considered as illustrative only. Further, because modifications and changes will readily occur to those of ordinary skill in the art, the invention should not be limited to the specific embodiments shown. Accordingly, the embodiments shown in the drawings are for purpose of illustrating the manner in which the present invention can be applied without, however, excluding other applications that fall within the spirit and scope of the appended claims.

We claim:

1. An article locating system, comprising:

a first unit including a first circuit for transmitting a first signal that is encoded with identification data that is uniquely associated with the first unit and for receiving a second signal, and an indicator connected to the first circuit, the first unit being operatively connected to a power supply having a given power output magnitude;

a second unit including a second circuit for receiving the first signal and for transmitting the second signal, the second unit being releasably attached to the article;

the first circuit for responding to the received second signal and for selectably activating the indicator to manifest the magnitude of the power output of the power supply and the proximate position of the second unit relative to the first unit for locating the article.

2. The system as recited in claim 1, wherein the first circuit includes a first microprocessor for generating the first signal and a transceiver connected to the first circuit for transmitting the first signal and for receiving the second signal.

3. The system as recited in claim 2, further comprising an activation arrangement operatively connected to the first circuit to actuate the microprocessor to generate the first signal.

4. The system as recited in claim 3, wherein the second signal is encoded with at least a portion of the identification data so that the second signal is unique to the second circuit.

5. The system as recited in claim 4, wherein the second circuit includes a second microprocessor for generating the second signal and a transceiver connected to the second circuit for receiving the first signal and for transmitting the second signal.

6. The system as recited in claim 5, wherein the second microprocessor is operatively connected to the transceiver of the second circuit for verifying the first signal, relative to the identification data.

7. The system as recited in claim 2, wherein the indicator is a visual display.

8. The system as recited in claim 7, wherein the visual display is a plurality of light emitting diodes, each diode being selectably operated by the microprocessor.

9. The system as recited in claim 8, wherein each diode is a different color from the others of said diodes and the first microprocessor is programmed to illuminate the diodes in a given sequence to indicate the proximity of the second unit relative to the first unit.

10. The system as recited in claim 9, wherein at least one diode is illuminated to indicate that the second unit is out of range.

11. The system as recited in claim 8, wherein the diodes are illuminated sequentially in a given order based upon the proximity of the second unit relative to the first unit.

12. The system as recited in claim 8, wherein the second unit includes a further indicator connected to the second circuit to indicate the proximate position of the second unit relative to the first unit.

13. The system as recited in claim 12, wherein the further indicator is an audio mechanism for emitting audible sounds.

14. The system as recited in claim 13, wherein the audio mechanism includes a speaker and a record-playback mechanism that is connected to the second circuit for recording and playing a pre-recorded message.

15. The system as recited in claim 14, wherein the record-playback mechanism is activated when the second circuit receives the first signal and plays the prerecorded message to notify a user of the proximate position of the article.

16. The system as recited in claim 7, wherein the indicator is a liquid crystal display.

17. The system as recited in claim 16, wherein the liquid crystal display has a graphic interface connected to the first circuit for selectably displaying objects and alphanumeric data to indicate the proximate position of the second unit relative to the first unit.

18. An article locating system, comprising:

a locator module including a first circuit for transmitting a search signal and for receiving a found signal, the locator module including a first power source;

a base module in selective communication with the locator module over free space including a second power source and a second circuit for receiving the search signal and for transmitting the found signal to the locator module in response to the received search signal, the base module being releasably attached to the article wherein the locator module includes an indicator operatively connected to the first circuit to manifest the proximate position of the base module relative to the locator module for locating the article in response to receipt of the found signal by the first circuit, and wherein the base module includes a record-playback mechanism that is connected to the second circuit for recording and playing messages.

19. The system as recited in claim 18, wherein the base module further comprises an indicator operatively connected to the second circuit for indicating the proximate position of the base module relative to the locator module for locating the article.

20. The system as recited in claim 19, wherein the indicator of the locator module is a visual display.

21. The system as recited in claim 18, wherein the record-playback mechanism plays the audible communication when the base module detects the search signal from the locator module.

22. The system as recited in claim 21, wherein the base module includes an indicator light to manifest the magnitude of the power output of the second power source.

23. The system as recited in claim 22, wherein the indicator of the locator module includes a visual display.

24. The system as recited in claim 23, wherein the visual display includes an array of light emitting diodes that are illuminated in a given sequence to indicate the proximate position of the locator module relative to the base module.

25. The system as recited in claim 24, wherein each diode is a different color.

26. The system as recited in claim 24, wherein the color of each diode is used to indicate that the base module is within a predetermined range relative to the locator module.

27. A system for locating an article, comprising:

a first unit for transmitting a first signal and for receiving a second signal, the first unit including a first housing and a first circuit within at least a portion of an interior of the first housing, the first circuit including a first indicator responsive to the received second signal;

a second unit for receiving the first signal and for transmitting the second signal in response to the receipt of the first signal, the second unit being attachable to the article and including a second housing and a second circuit within at least a portion of an interior of the second housing; and a second indicator connected to the second circuit of the second unit that is activated in response to the first signal being received by the second unit, wherein the second indicator includes a record-playback mechanism and an audio device for playing a pre-recorded audible communication to manifest the proximate position of the second unit relative to the first unit for locating the article.

28. A method for locating an article, comprising:

providing a locator unit for transmitting a first signal and for receiving a second signal, the locator unit including a microprocessor and a transceiver connected to a first circuit, the microprocessor generating and encoding the first signal with identification data that is unique to the locator unit;

providing a base unit for receiving the first signal and for transmitting the second signal to the locator unit in response to the first signal, the base unit being attached to the article and including a microprocessor and a transceiver connected to a second circuit, the microprocessor generating and encoding the second signal with identification data that is unique to the base unit in response to receiving the first signal;

providing a first indicator connected to the first circuit to manifest the proximate position of the article in response to the second signal; and providing a second indicator connected to the second circuit, the second indicator including a record/playback device for recording desired messages to be played, wherein the desired messages are played in response to the base unit receiving the first signal from the locator unit to manifest the proximate position of the base unit relative to the locator unit for locating the article.

29. An article locating system for locating an article, comprising:

a first unit for transmitting a first encoded signal and for receiving and verifying a second encoded signal, the first unit having a first circuit and a programmable microprocessor to encode the first encoded signal with identification data that is uniquely associated with the first unit; and a second unit removably attached to the article for receiving and verifying the first encoded signal and for transmitting the second encoded signal, the second unit having a second circuit and a second programmable microprocessor that is used to verify the first encoded signal, relative to the identification data, to encode the second encoded signal, and to transmit the second encoded signal to the first unit, and an indicator connected to the first unit to manifest the proximate location of the first unit relative to the second unit for locating the article when the first unit receives and verifies the second encoded signal.

* * * * *